US005406721A

United States Patent [19]

Marcolin

[11] Patent Number: 5,406,721

[45] Date of Patent: Apr. 18, 1995

[54] SPORTS SHOE STRUCTURE

[76] Inventor: Alessandro Marcolin, Via Chiesa 8, 31010 Crespignaga Di Maser, Italy

[21] Appl. No.: 870,853

[22] Filed: Apr. 20, 1992

[51] Int. Cl.[6] ..... A43B 21/00; A43B 5/04

[52] U.S. Cl. ..... 36/105; 36/121

[58] Field of Search ..... 36/121, 105, 88, 96, 36/107, 115, 58.5, 69, 89, 76 C

[56] References Cited

U.S. PATENT DOCUMENTS

| | | | |
|---|---|---|---|
| 1,236,714 | 8/1917 | Hoppe | 36/89 |
| 3,599,351 | 8/1971 | Check | 36/121 |
| 3,678,603 | 7/1972 | Kaufman et al. | 36/118 |
| 3,710,484 | 1/1973 | Heitzinger | 36/118 |
| 3,775,871 | 12/1973 | Serko | 36/121 |
| 4,030,214 | 6/1977 | Hanson et al. | 36/105 |
| 4,073,073 | 2/1978 | Seidel | 36/121 |
| 4,404,757 | 9/1983 | Sweeny | 36/76 C |
| 4,655,465 | 4/1987 | Schaeffer | 36/115 |
| 4,897,940 | 2/1990 | Sartor | 36/121 |
| 5,063,690 | 11/1991 | Slenker | 36/136 |

FOREIGN PATENT DOCUMENTS

| | | | |
|---|---|---|---|
| 1249653 | 11/1960 | France | 36/89 |

*Primary Examiner*—Steven N. Meyers

*Attorney, Agent, or Firm*—Guido Modiano; Albert Josif; Daniel O'Byrne

[57] ABSTRACT

The sports shoe structure, particularly but not exclusively for practicing skating, parachute gliding and cross-country skiing includes an upper with which a cuff is associated, a supporting element for the ankle which is removably associable with the structure and which has a plurality of tabs which can be associated with the upper and can be interposed laterally between the cuff and the upper.

11 Claims, 2 Drawing Sheets

SPORTS SHOE STRUCTURE

BACKGROUND OF THE INVENTION

The present invention relates to a sports shoe structure, particularly but not exclusively usable for skating, parachute gliding and cross-country skiing.

The problem of protecting and supporting the ankle from the considerable stresses due to the particular sport is currently felt in known types of these shoes.

These sports can currently be practiced by using a known sports shoe, which is usually constituted by a complete upper with which a reinforcement element is laterally associated; said reinforcement element is constituted by a plate which is rigidly associated therewith by sewing.

Said supporting element is thus arranged inside an appropriate seat defined on each of the two sides of the upper at the malleolus.

Said known structure is bare and simple in its construction, and has, in use, deformations which are not very correct from an anatomical point of view during the practice of the sport; the ankle is in fact not optimally supported.

Therefore, said structure does not completely comply with the particular morphology of the ankle.

The supporting elements for supporting the ankle furthermore often break due to the considerable intensity of the stresses applied to the shoe during sports activity; furthermore, said supports cannot be replaced due to the fact that they are rigidly associated inside the upper.

This situation therefore forces a user to purchase a new shoe which, in the course of time, will be replaced as well.

It is therefore evident that said shoe structure, due to the above described facts, does not perform its orthopedic function correctly.

In known shoes there is also a protrusion on the upper which is due to the presence of the reinforcement element.

SUMMARY OF THE INVENTION

The aim of the present invention is to eliminate the problems described above in known types by providing a sports shoe structure which allows to optimally support the ankle without however limiting movements thereof.

Another object of the invention is to have no elements subject to breakage during the practice of the sport which compromise the further use of the shoe.

A further object is to provide a sports shoe structure which allows to adapt the degree of ankle support to the specific requirements of the athlete.

Another object is to provide a sports shoe structure which allows to assure a support which generally corresponds to the characteristic requirements of the ankle.

Not least object is to provide a sports shoe structure which associates with the preceding characteristics that of being reliable and safe in use.

This aim, these objects and others are achieved by a sports shoe structure which is characterized in that it comprises an upper with which a cuff is associated, an elastically deformable supporting means for the ankle being removably associable with said structure, said supporting means having a plurality of tabs which can be associated with said upper and which can be interposed laterally between the latter and said cuff.

BRIEF DESCRIPTION OF THE DRAWINGS

Further characteristics and advantages of the invention will become apparent from the detailed description of a particular embodiment, illustrated only by way of non-limitative example in the accompanying drawings, wherein.

DESCRIPTION OF THE PREFERRED EMBODIMENTS

Figure 2:
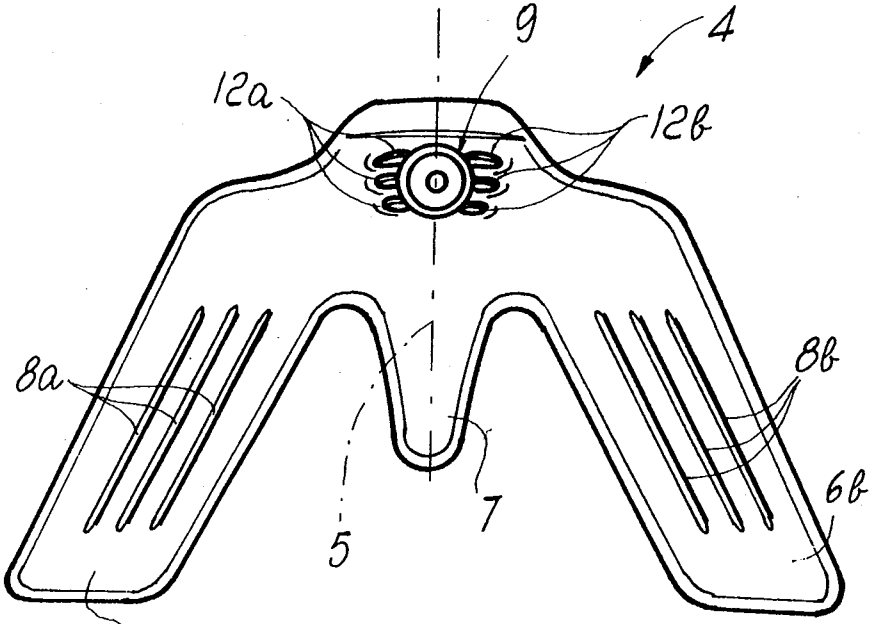
FIG. 2 is a front view of the supporting element.
Figure 1:
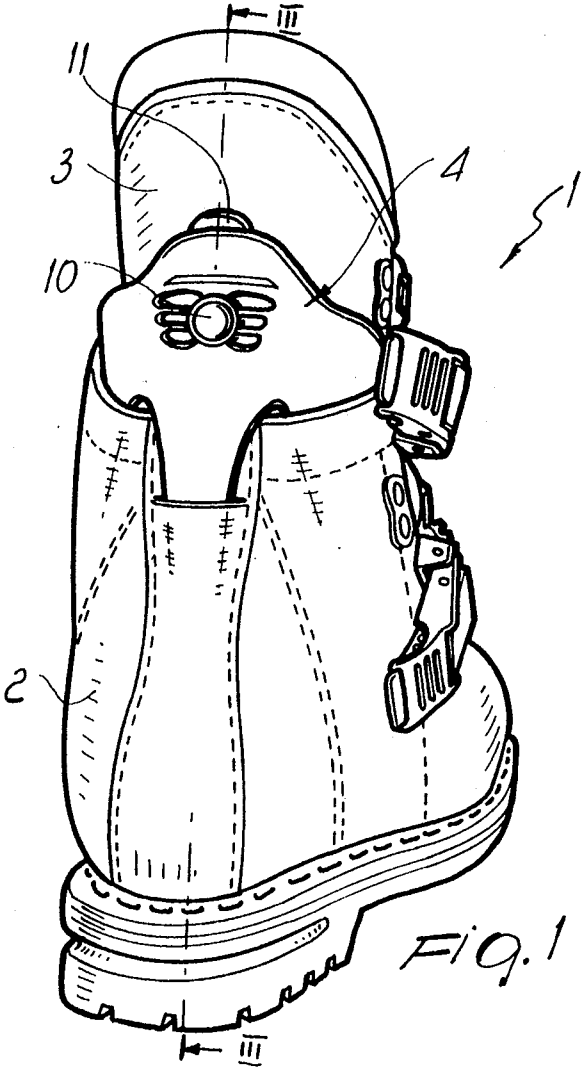
FIG. 1 is a rear view of the supporting element associated with the sports shoe structure.
Figure 3:
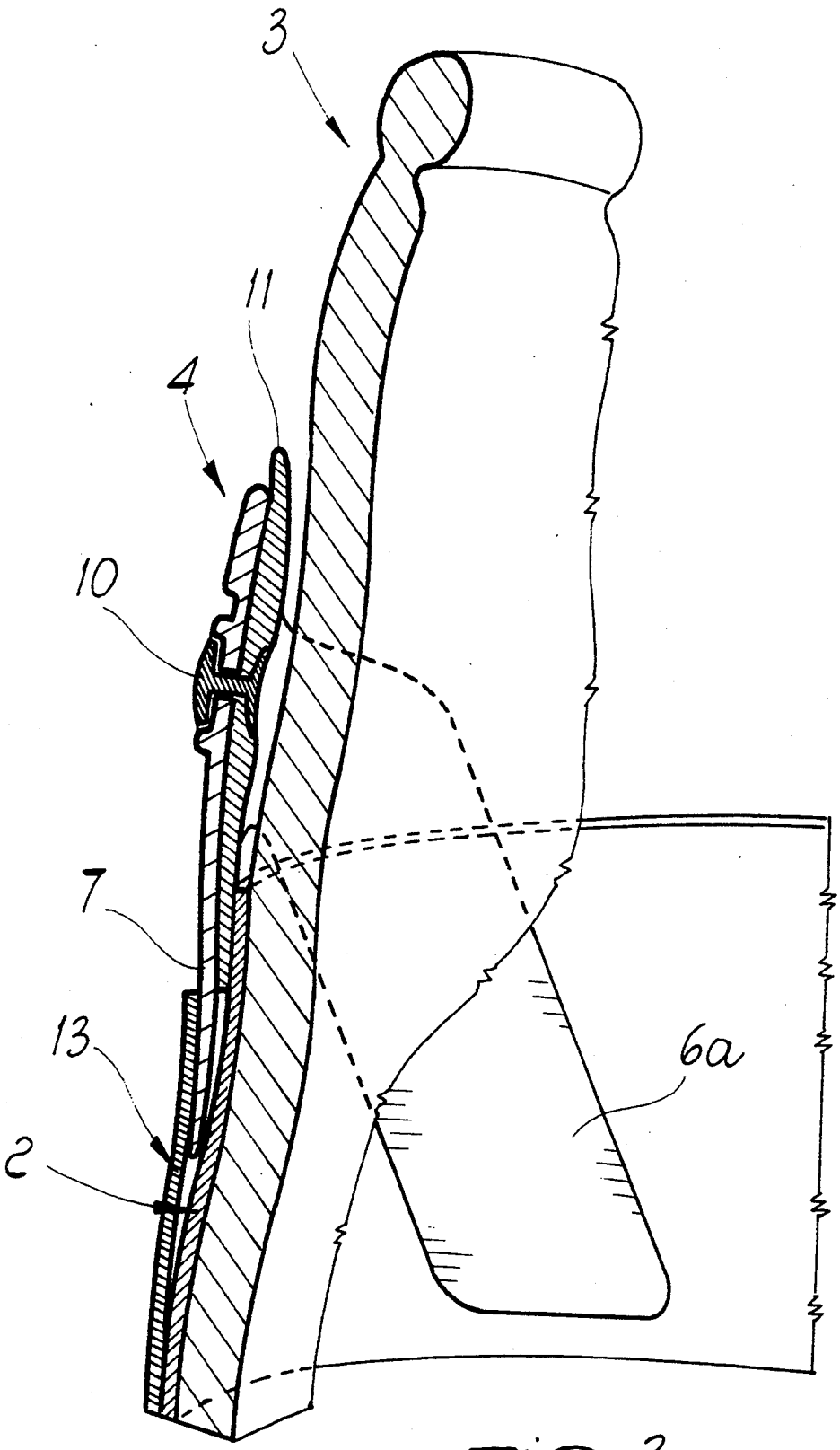
FIG. 3 is a sectional view of the structure, taken along the plane III—III of FIG. 1.

With reference to the above figures, the sports shoe structure, generally designated by the reference numeral 1, includes an upper 2 to which a cuff 3 is sewn; said cuff protrudes upwardly from said upper.

The structure 1 further comprises a supporting element which is specular with respect to a median axis, designated by the numeral 5, and is preferably made of plastic material.

The supporting element 4 has an M-shaped plan configuration; it is thus composed of a pair of side wings a and **6*b* which are connected by a central tab 7 which is arranged along the median axis 5**.

A plurality of ridges **8*a* and 8*b*, suitable for stiffening the supporting element 4, is present on each wing of said pair of wings 6*a* and 6*b***.

Grooves may alternatively be provided instead of the ridges.

A circular seat 9 is provided in the region which connects the wings **6*a* and 6*b* and the central tab 7, for the possible temporary accommodation of a rivet 10 for connecting the supporting element 4 to a tongue 11 which protrudes to the rear of the upper 2**.

A plurality of through slots **12*a* and 12*b*, arranged perpendicular to the median axis 5, is defined laterally to the circular seat 9**.

The two wings **6*a* and 6*b* converge toward the median axis 5** and thus have a given angle.

Said pair of wings can vary in thickness starting from the central tab 7 up to their free end.

Said supporting element 4, and in particular the wings **6*a* and 6*b***, can deform elastically.

A pocket 13, which acts as seat for temporary engagement with the central tab 7 of the supporting element 4, is defined at the tongue 11.

Each wing **6*a* and 6*b* can be interposed between the inner lateral surface of the upper 2 and the outer surface of the cuff 3**.

The temporary insertion of the wings **6*a* and 6*b* between the upper and the cuff therefore allows to stiffen the shoe structure 1** in the ankle region.

In addition to supporting the ankle rearwardly, the central tab 7 also allows to stop the backward stroke of the cuff 3.

It has thus been observed that the invention has achieved the intended aim and objects, a sports shoe structure having been provided wherein the supporting element 4, connected between the cuff 3 and the upper 2, optimally supports the lateral rear region of the ankle without however limiting its movements.

Specifically, said supporting element 4, by cooperating with the upper 2 and the cuff 3, assures the effective stopping of the return of the ankle during the movements produced during sports practice and supports said ankle laterally in an optimum manner.

During said sports practice, even after lateral flexing or sudden bending, the ankle is always correctly arranged inside the upper.

This allows the athlete to serenely achieve, by using this particular sports shoe, a sports practice which is free from physical problems, such as aches or pains localized at the ankle; by virtue of the particular structural configuration of said sports shoe one thus achieves correct ankle support.

The described invention furthermore allows to provide a shoe, for example for skating, which lasts longer since it withstands wear much better than the known art.

The removability of the supporting element 4 allows to use said element on different types of shoes in the sizes most appropriate for the sports activity and for the anatomical configuration of the user's foot.

I claim:

1. Sports shoe structure, comprising an upper (2);

a cuff (3) connected to said upper (2);

an elastically deformable ankle supporting element (4) defining a median axis (5), said supporting element (4) having a central tab (7) located at said median axis, and a pair of lateral wings (6*a*, 6*b*) connected to said central tab (7), said pair of lateral wings (6*a*, 6*b*) and said central tab (7) together imparting to said supporting element (4) an M-shaped plan configuration said tab being removably laterally interposable between said upper (2) and said cuff (3)

a circular seat (9) formed in said central tab (7) at a portion thereof connected to said wings (6*a*, 6*b*);

a rivet (10) at least temporarily accommodated in said seat (9);

a tongue (11) connected to said supporting element (4) by said rivet (10) and protruding rearwardly of said upper (2), and;

a pocket (13) defined at said tongue (11) and defining a seat for temporary engagement with said central tab (7) and said supporting element (4).

2. Sports shoe structure according to claim 1, wherein said upper (2) has an inner lateral surface and wherein said cuff (3) has an outer surface, each of said wings (6*a*, 6*b*) being interposed between said inner lateral surface of said upper (2) and said outer surface of said cuff (3).

3. Sports shoe structure comprising;

an upper (2);

a cuff (3) connected to said upper (2) and protruding upwardly therefrom;

an elastically deformable ankle supporting element (4) defining a median axis (5), said supporting element (4) having a central tab (7) located at said median axis, and at least two lateral wings (6*a*, 6*b*) connected to said central tab (7), said at least two lateral wings (6*a*, 6*b*) and said central tab (7) together imparting to said supporting element (4) an M-shaped plan configuration said tab being removably laterally insertable between said upper (2) and said cuff (3).

4. Sports shoe structure according to claim 3, wherein said upper (2) has an inner lateral surface and wherein said cuff (3) has an outer surface, each of said wings (6*a*, 6*b*) being interposed between said inner lateral surface of said upper (2) and said outer surface of said cuff (3).

5. Sports shoe according to claim 3, further comprising;

at least one seat (9) formed in said central tab (7) proximate to a portion thereof connected to said wings (6*a*, 6*b*), and;

at least one connection element (10) at least temporarily accommodated in said seat (9).

6. Sports shoe according to claim 5, further comprising at least one tongue (11) connected to said supporting element (4) by said connection element (10) and protruding rearwardly of said upper (2).

7. Sports shoe structure according to claim 4, further comprising at least one pocket (13) defined at said tongue (11) and defining a seat for temporary engagement with said central tab (7) and said supporting element (4).

8. Sports shoe structure comprising;

an upper (2);

a cuff (3) connected to said upper (2) and protruding upwardly therefrom;

at least one elastically deformable ankle supporting element (4) defining a median axis (5), said supporting element (4) having a central tab (7) located at said median axis, and at least two lateral wings (6*a*, 6*b*) connected to said central tab (7), said at least two lateral wings (6*a*, 6*b*) and said central tab (7) together imparting to said supporting element (4) an M-shaped plan configuration said tab (7) being removably laterally insertable between said upper (2) and said cuff (3);

wherein said upper (2) has an inner lateral surface and wherein said cuff (3) has an outer surface, each of said wings (6*a*, 6*b*) being interposed between said inner lateral surface of said upper (2) and said outer surface of said cuff (3).

9. Sports shoe according to claim 8, further comprising;

at least one seat (9) formed in said central tab (7) proximate to a portion thereof connected to said wings (6*a*, 6*b*), and;

at least one connection element (10) at least temporarily accommodated in said seat (9).

10. Sports shoe according to claim 9, further comprising at least one tongue (11) connected to said supporting element (4) by said connection element (10) and protruding rearwardly of said upper (2).

11. Sports shoe structure according to claim 10, further comprising at least one pocket (13) defined at said tongue (11) and defining a seat for temporary engagement with said tab (7) and said supporting element (4).

* * * * *